US008181379B2

(12) United States Patent
Brewer

(10) Patent No.: US 8,181,379 B2
(45) Date of Patent: May 22, 2012

(54) COMPOSITE GUN SCOPE COVER

(76) Inventor: Edwin F. Brewer, Sandy, UT (US)

( * ) Notice: Subject to any disclaimer, the term of this patent is extended or adjusted under 35 U.S.C. 154(b) by 119 days.

(21) Appl. No.: 12/384,344

(22) Filed: Apr. 3, 2009

(65) Prior Publication Data

US 2010/0251594 A1 Oct. 7, 2010

(51) Int. Cl.
*F41G 11/00* (2006.01)
*B65D 65/04* (2006.01)

(52) U.S. Cl. ..... 42/129; 42/143; 150/154

(58) Field of Classification Search ..... 42/129, 42/143; 150/154; D3/263; 206/317
See application file for complete search history.

(56) References Cited

U.S. PATENT DOCUMENTS 2,968,099 A * 1/1961 Peters, Jr. ..... 42/129
D209,050 S * 10/1967 Saari et al. ..... D3/263
3,496,642 A * 2/1970 Pfahler ..... 42/129
3,746,423 A * 7/1973 Mills ..... 359/511
5,150,528 A * 9/1992 Shire ..... 42/129
5,183,953 A 2/1993 Anderson et al.
5,566,490 A * 10/1996 Owen ..... 42/90
5,850,706 A 12/1998 Evans

* cited by examiner

*Primary Examiner* — Bret Hayes
(74) *Attorney, Agent, or Firm* — Thorpe North & Western LLP

(57) ABSTRACT

A composite gun scope full cover for a gun scope secured with a mounting base to a gun comprising a pair of interacting partial substantially identical scope covers; each partial cover including a body of flexible sheet material having a top surface and spaced apart depending walls of a length sufficient to cover about one-half of the length of the scope; an end lens cover at one end of the body to cover either the eye piece end or the distal end of the scope; a strap extending from the opposite end of the body; an opening between the body and the strap and resilient, stretchable material between the end cover and one end of the strap that engages the mounting base during use of the partial cover to cover an end of the scope, whereby one strap of one partial cover is inserted through the opening of the other partial cover so that the opening of the inserted partial cover will fit over an end of the scope to be pulled against the base mount and stretched over an end of the scope opposite to the end covered by the first partial cover.

16 Claims, 9 Drawing Sheets

COMPOSITE GUN SCOPE COVER

CROSS-REFERENCE TO RELATED APPLICATIONS

Figure 1:
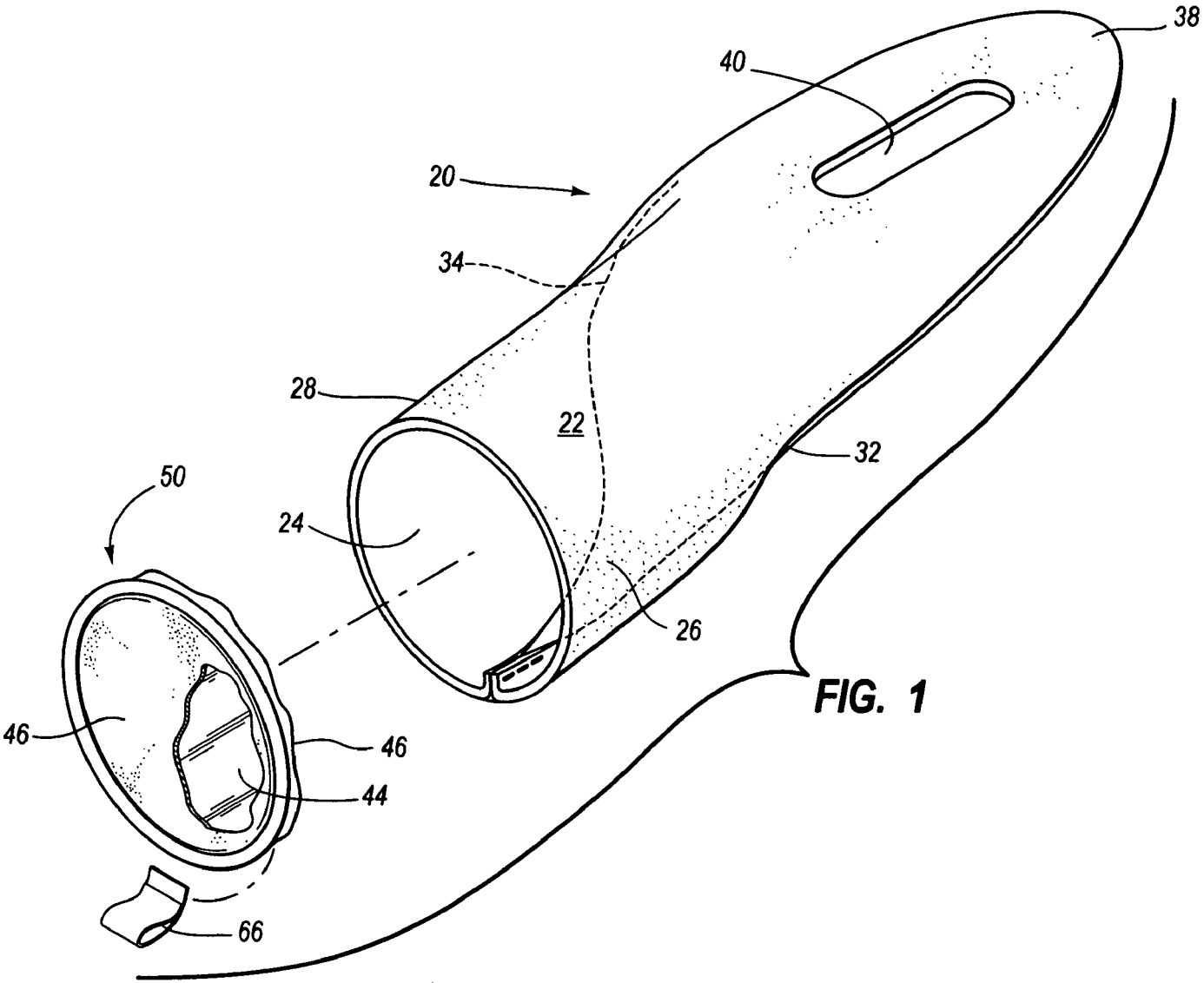

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

This invention relates to protective covers for gun scopes. It is particularly concerned with scope covers that can be removably positioned to provide protective covers for the length of such scopes and that include protective end covers to protect and cover both the eye piece and the distal ends of such scopes.

Gun scopes for both rifle and pistols generally include a mounting base that is used to adapt the scope to fit on a gun. It is therefore desirable to provide a protective cover that can be used with scopes of differing sizes and configurations, and having different scope and mount base lengths and configurations.

2. Prior Art

There have been various kinds and types of protective covers for rifle and pistol scopes disclosed and available for use in the past. Known covers have generally included a tubular housing that will fit over the length of the scope, from eye piece end to distal lens end. It has been known to make such previously available scope covers from water proof, stretchable, and resilient materials. The known scope covers have generally had cylindrical shaped bodies. The cylindrical bodies are then provided with elongate slots extending essentially the length of the bodies and are resilient so that the bodies can be stretched over the length of the scope whereby the ends of the body will cover both the eye piece end and the distal end of the scope. Resilient rings maybe provided to telescope over the scope at opposite ends of a support mount for the scope. The rings secure a center section of the body to a center section of the scope, even when one or both of the end pieces of the body are pulled from coverage of the eye piece end, and the distal end of the scope, and then are released to snap back to be located on top of one or both scope ends.

BRIEF SUMMARY OF THE INVENTION

Objects of the Invention

It is a principal object of the present invention to provide a protective cover for a rifle (or pistol) scope. Another object is to provide a cover suitable for use on scopes of different sizes and having differing mounting structures that will secure the scopes to guns.

An additional object is to provide a cover for a scope that will protect the scope from weather, possible damage due to engagement of the scope with solid objects, and that will be easy to position on a scope.

Still other objects are to provide a partial protective cover for a scope that will mount on the scope in such a manner that the lens cover of the installed partial covers can be easily slipped off one end of the scope while the remainder of the partial protective cover stays in position on the scope housing.

Yet another object is to provide a cover that will provide protection for both an eye piece end and a distal end of a scope, and with the lens cover at opposite ends of the scope being movable to an out-of-the way position, to facilitate use of the scope, while the central housing portion of the cover remains in position on the central housing portion of the scope.

Another object is to, provide a full composite cover for a scope that is made in two identical partial covers, each partial cover being arranged to be secured to a central portion of the scope and to a mounting assembly for the scope and each partial cover having an end portion forming a protective cover for one end of the scope. The partial covers can be used individually to protect a single end of the scope, or together to protect both ends and the full length of the scope.

Features of the Invention

Principal features of the invention include a full composite cover made of two structurally and functionally substantially identical partial covers.

Each partial cover of the full cover is made to include a top central length having a strap formed at one end and an end lens cover formed at an opposite end. Between the strap portion most remote from the lens cover and the lens cover, each partial cover is formed to have one opening and a resilient length portion. In use, the strap portion of one partial cover is positioned to engage one end of the mounting structure i.e., scope mount, for the scope. The lens cover is pulled and the resilient length portion stretches until the end cover portion fits over the end of the scope that is remote from the end of the mounting structure engaged by the strap. The strap of the partial cover passes beneath one end of the scope and engages one end of the scope mount. The body of a partial cover fits over and protects a central length of the scope that is connected to the end of the scope to be covered by the protective end cover portion of the partial cover. When a first partial cover of a full cover is positioned for use, with the strap engaging the mount for the scope, a second partial cover which is identical or substantially identical in construction to the first partial cover, is positioned for use by extending the strap of the second partial cover through the opening of the first partial cover and over and beneath the end of the scope covered by the first partial cover. The body of the second partial cover is stretched to place the end cover of the second partial cover over the opposite end of the scope and the strap into engagement with the scope mount.

With the straps of both partial covers engaging opposite ends of the scope mount, the partial covers can be stretched to extend the protective covers over the opposite ends of the scope, with the body of each partial cover covering an intermediate portion of the scope length. With the partial covers so attached, the protective end covers of the partial covers can be released from the scope to be supported on top of gun barrel.

Additional objects and features of the invention will become apparent to persons skilled in the art to which the invention pertains from the following detailed description and claims.

BRIEF DESCRIPTION OF THE FIGURES OF THE INVENTION

In the Drawings

Figures 2, 3, 4, 5, 6:
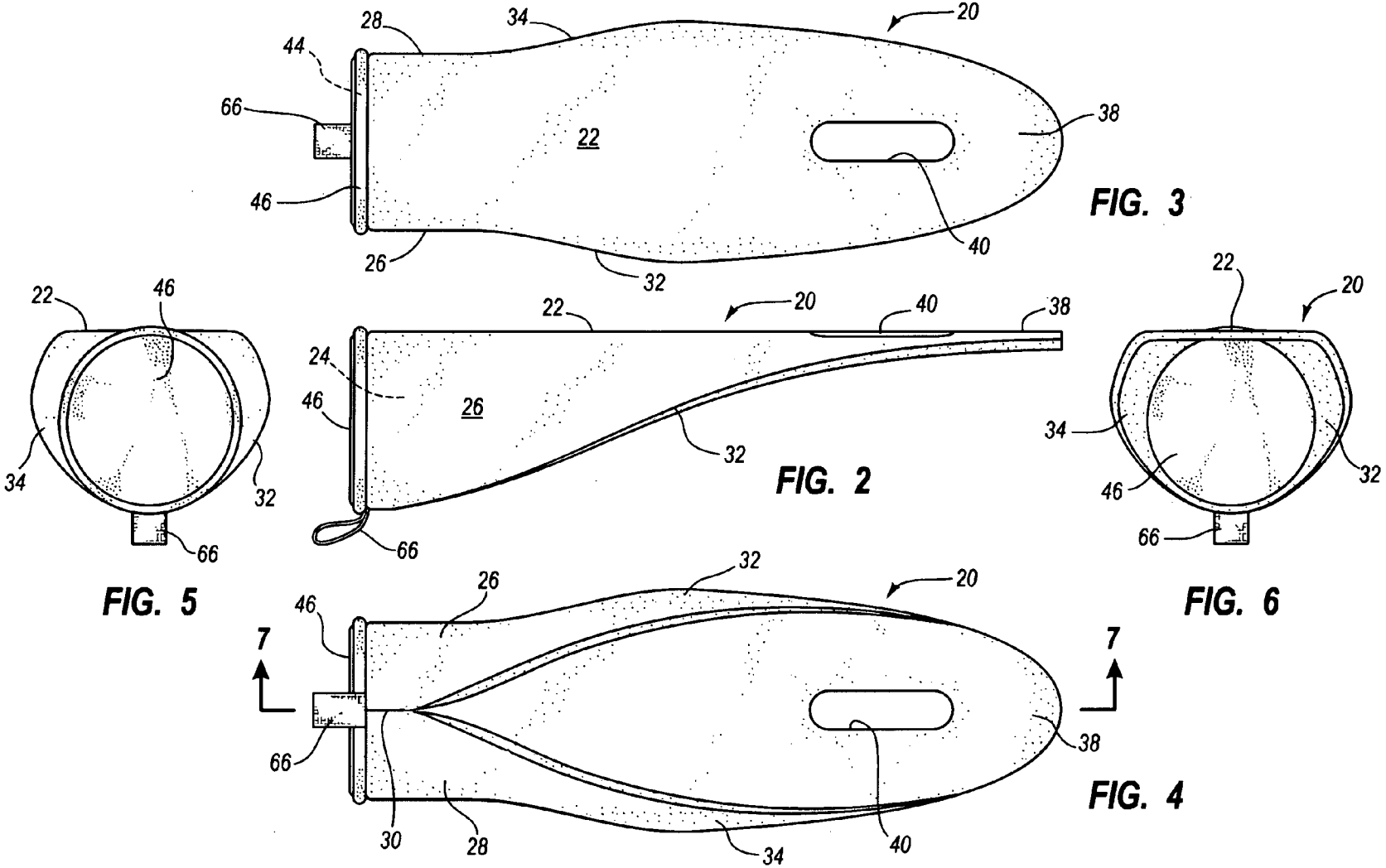
Figure 7:
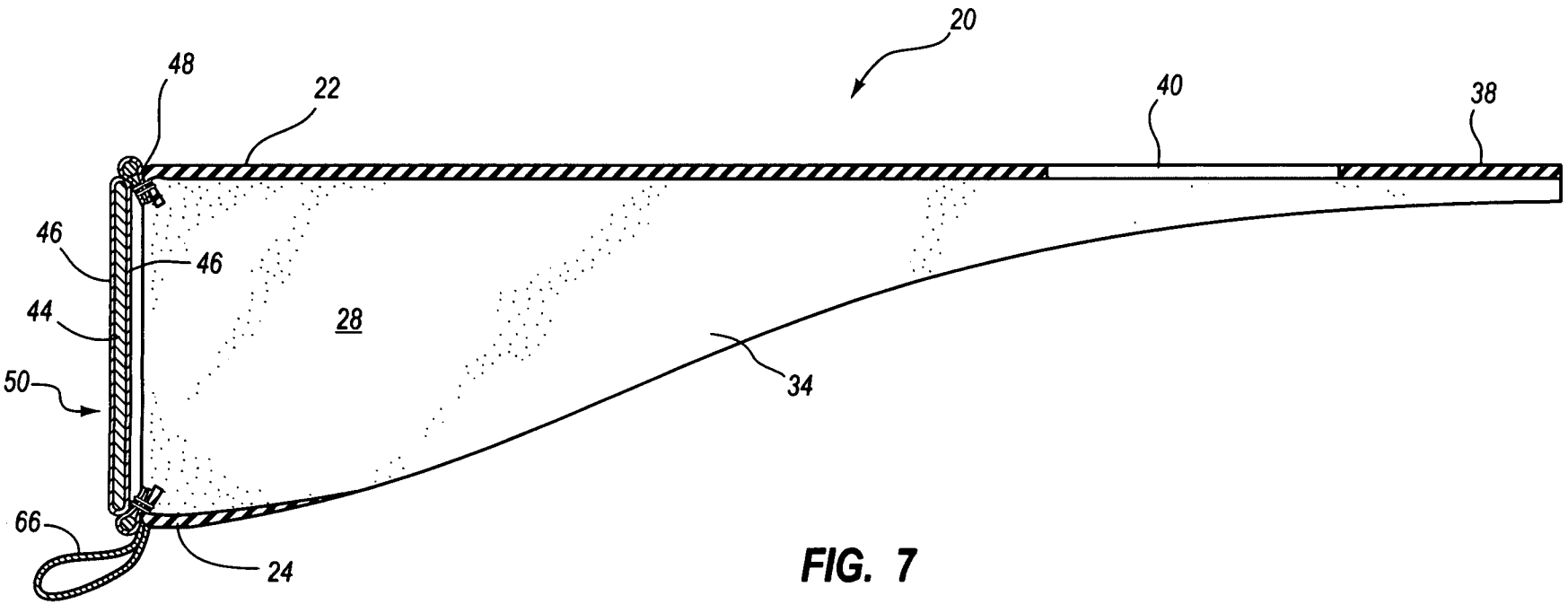
Figure 8:
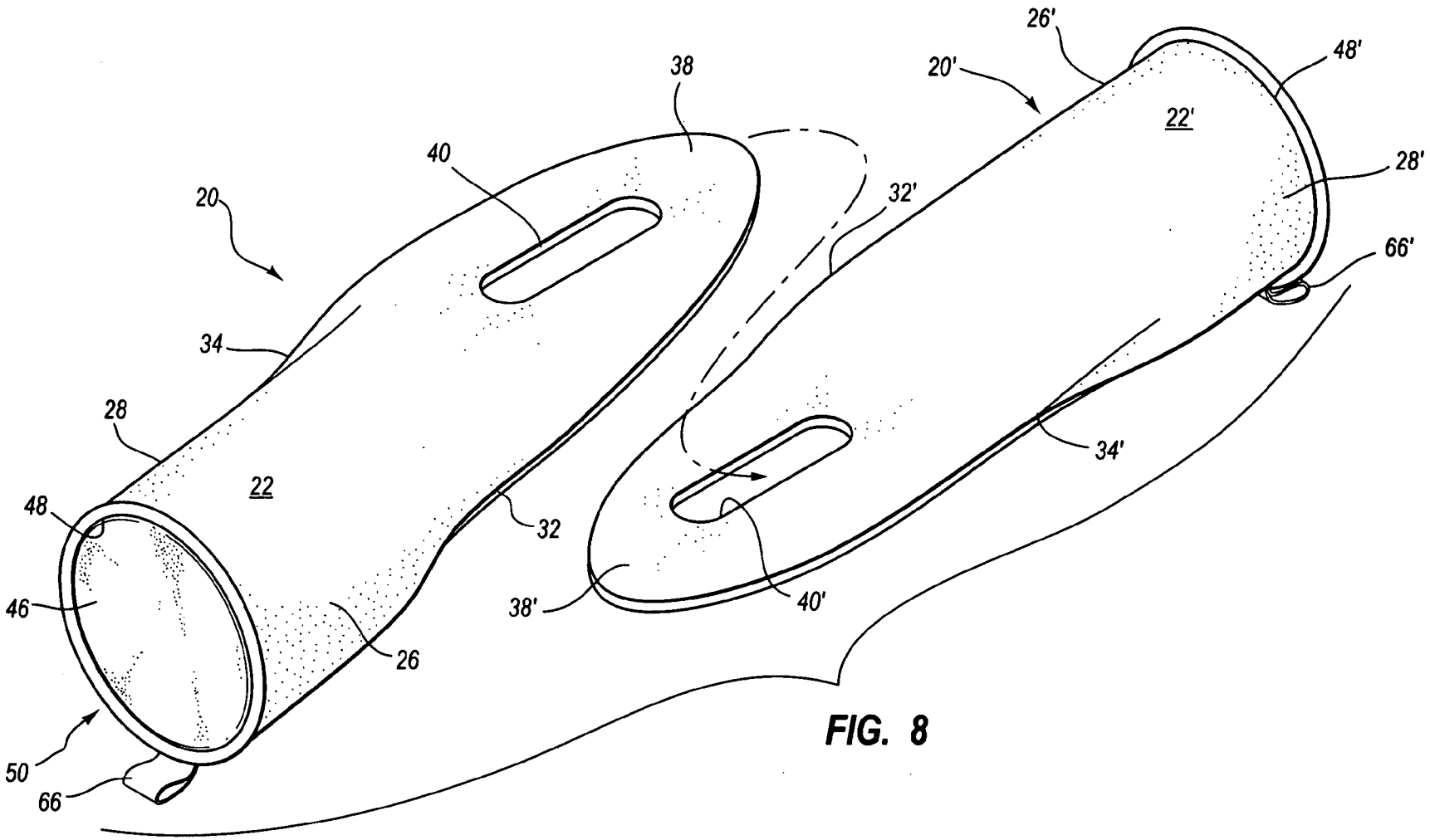
Figure 9:
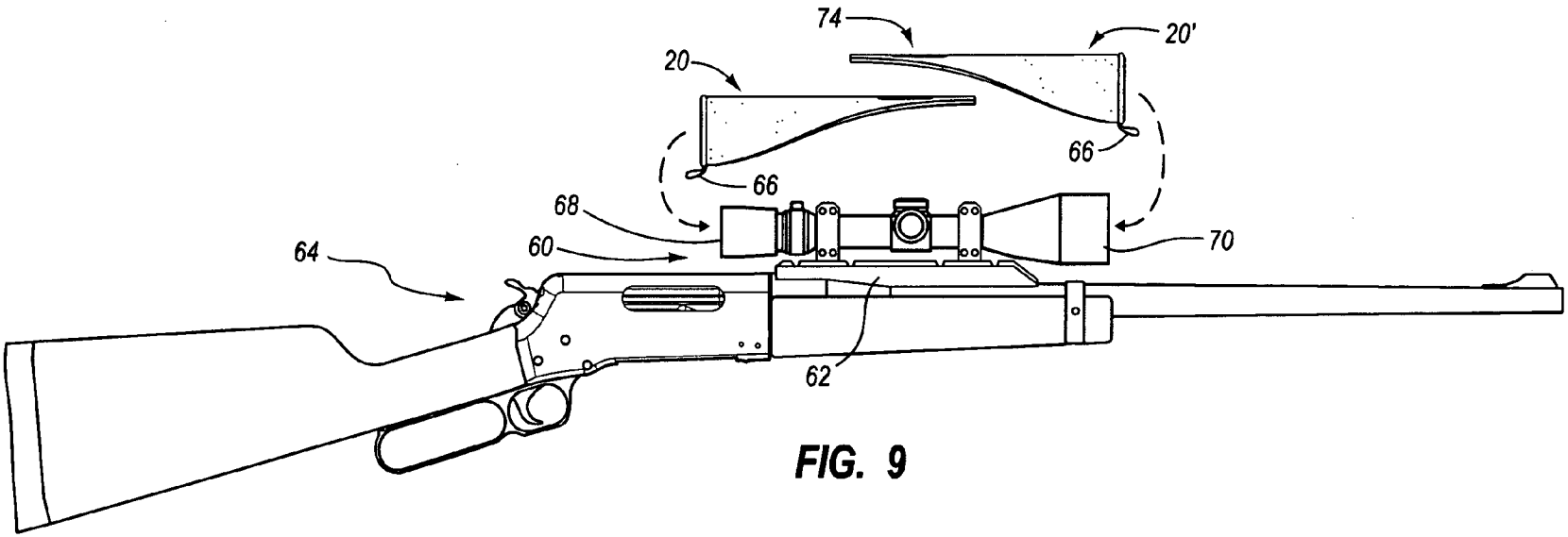
Figure 11:
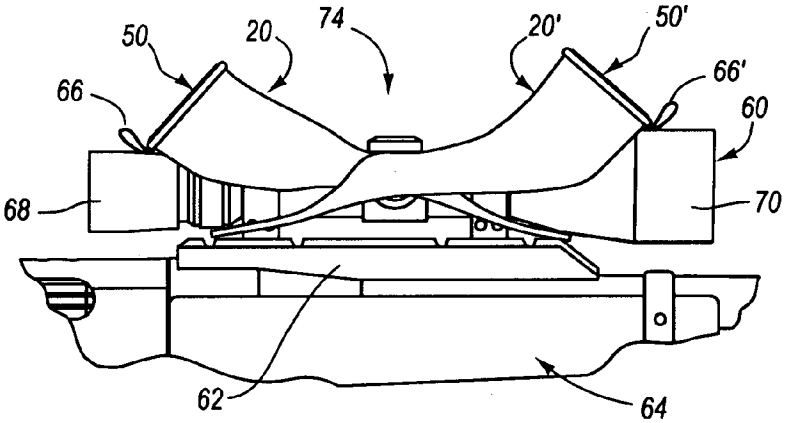
Figure 10:
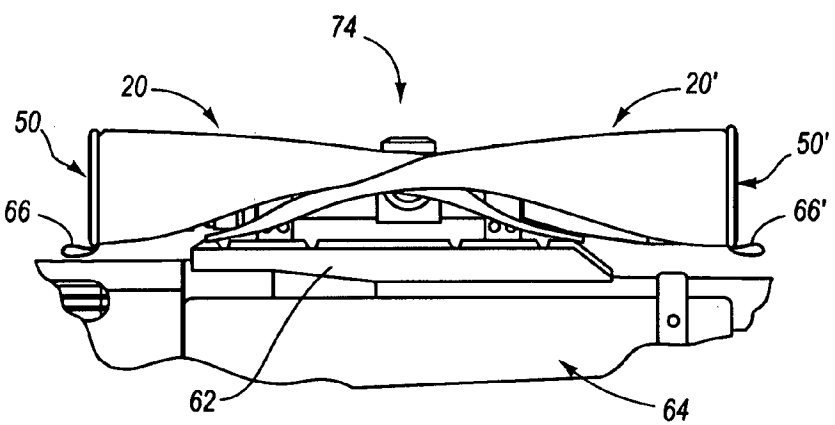
Figure 12:
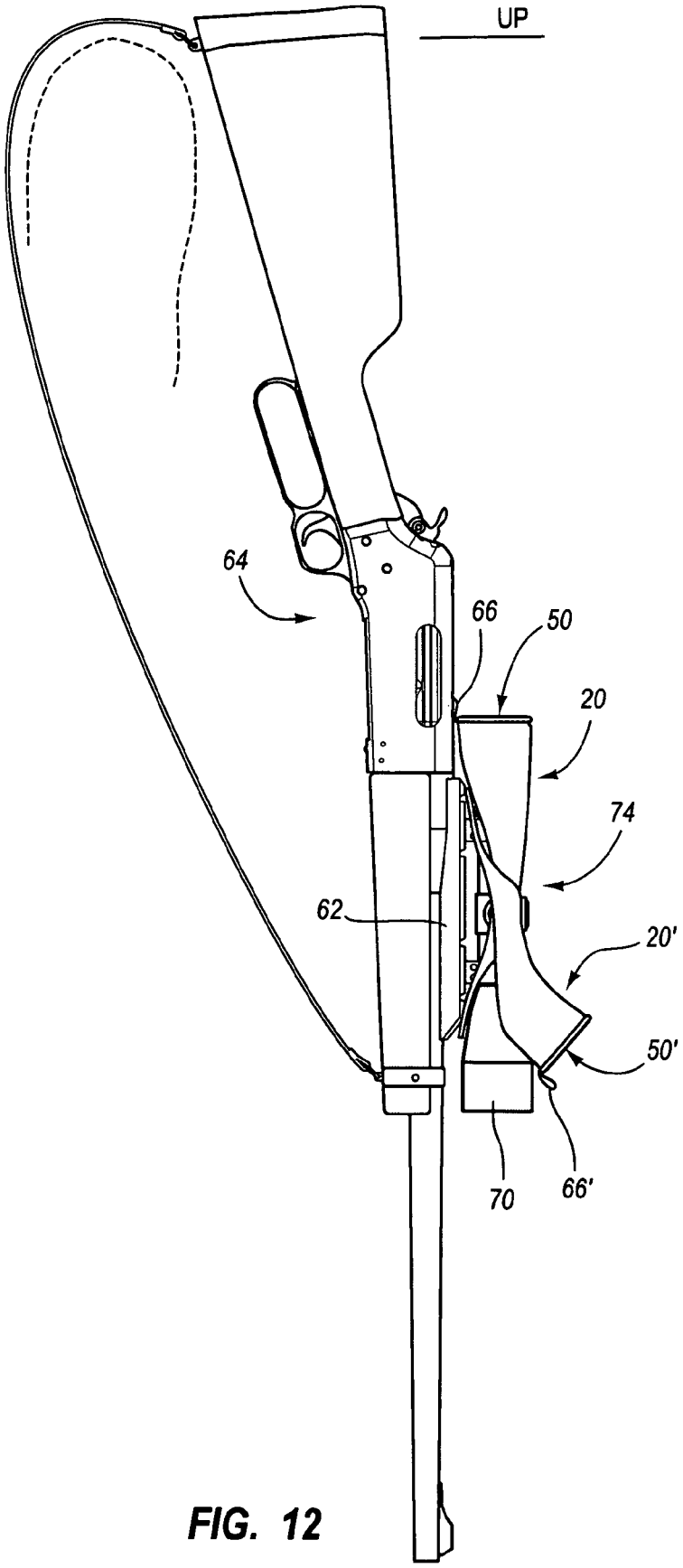
Figure 13:
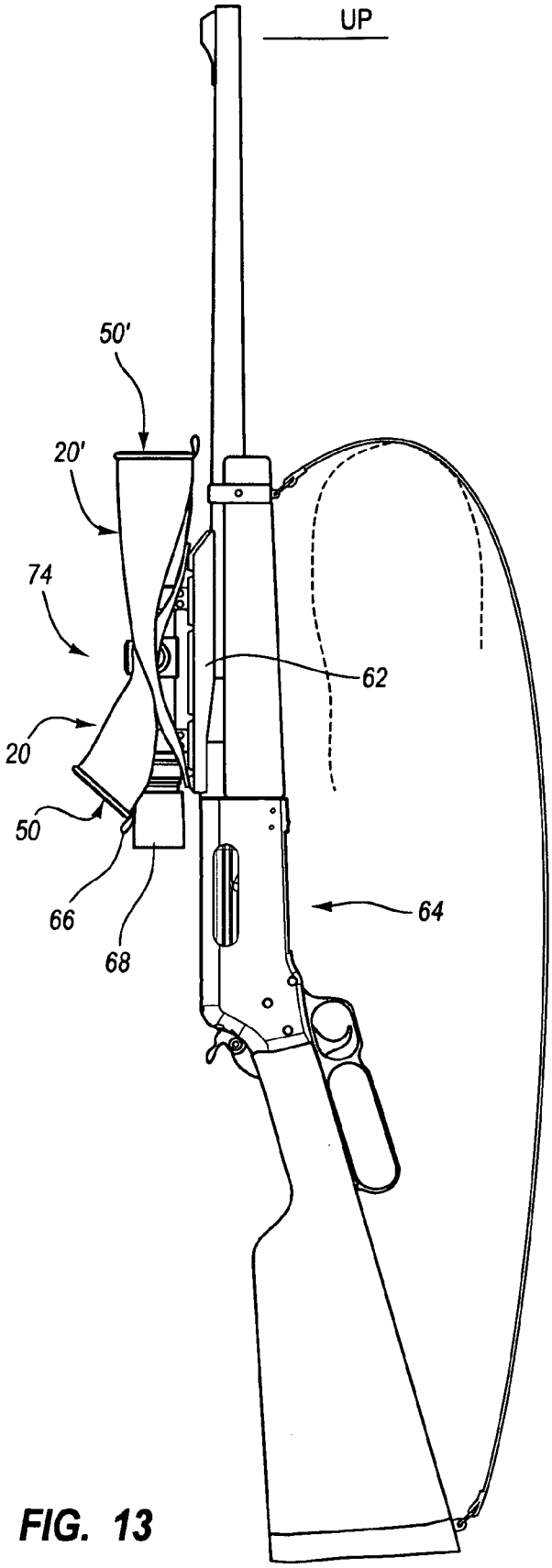
Figure 14:
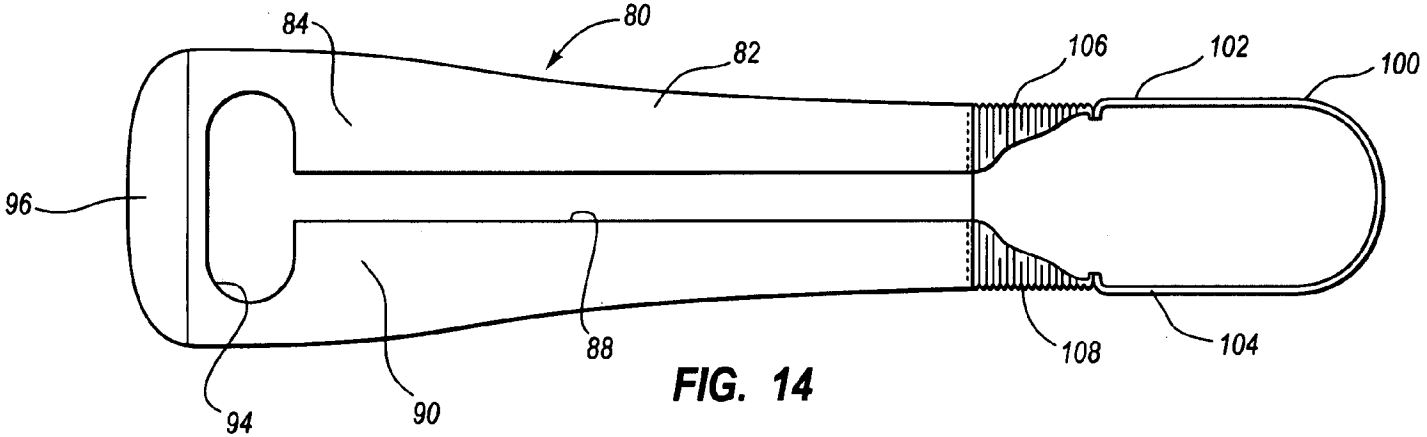
Figure 15:
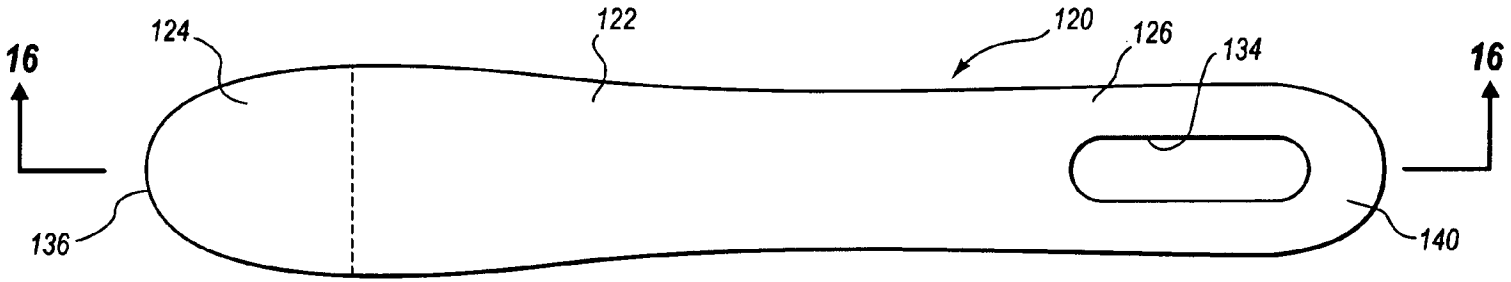
Figure 16:
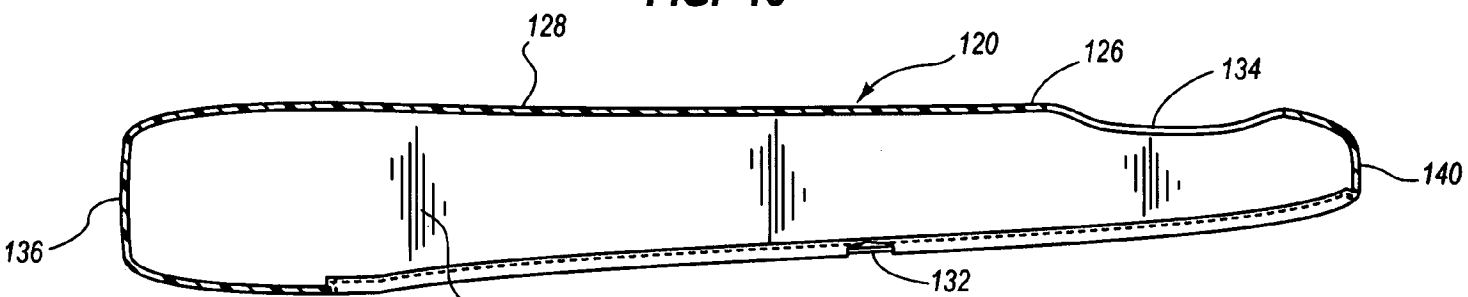
Figure 17:
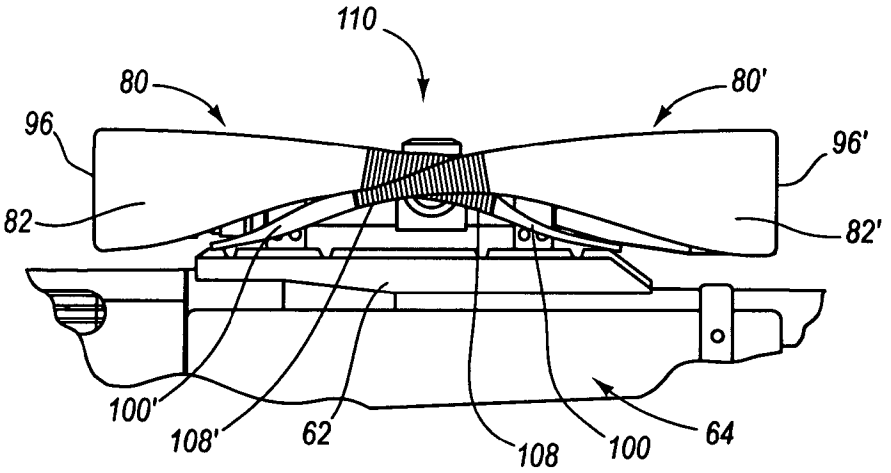
Figure 18:
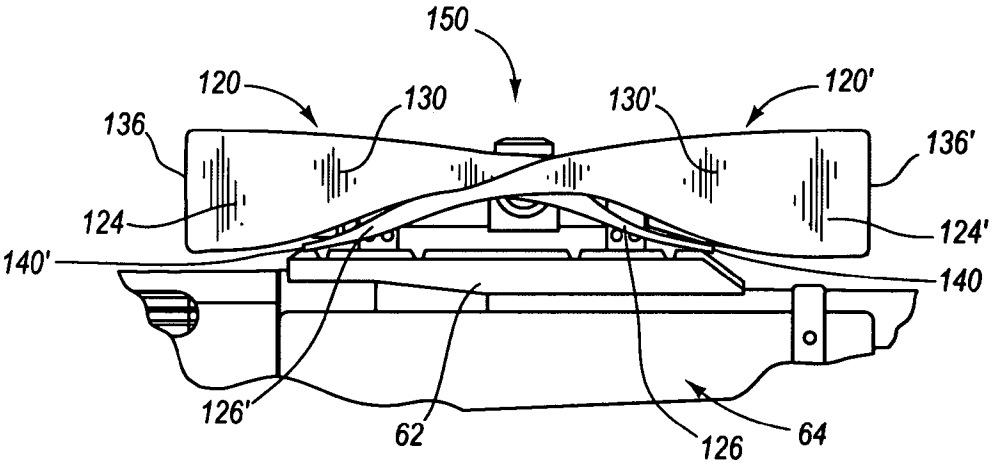

FIG. 1 is an exploded top view of a partial scope cover of a preferred embodiment of the invention, showing a body section including a tail piece and having a formed strap, all as cut from a flat piece of material; a lens cover partially broken away to show interior details, and a pull loop at the lens cover end of the body section;

FIG. 2, a top plan view of the assembled partial scope cover of FIG. 1;

FIG. 3, a side elevation view;

FIG. 4, an end elevation view of the lens cover end of the partial scope cover;

FIG. 5, an end elevation of the strap end of the partial scope cover;

FIG. 6, a bottom plan view;

FIG. 7, an enlarged vertical section view taken on the line 7-7 of FIG. 2;

FIG. 8, a perspective view of a pair of partial scope covers, showing interaction (by dotted lines) of the pair of partial scope covers to form a composite full scope cover for protecting the full length and opposite ends of a scope;

FIG. 9, an exploded side elevation showing a rifle with a telescopic sight, i.e., scope, mounted thereon and a pair of partial scope covers being positioned (by dotted lines) as a full cover to protect the scope;

FIG. 10, a side elevation view showing a pair of partial scope covers installed and stretched as a composite full cover over the full length of the scope;

FIG. 11, a view like that of FIG. 10, but with each partial scope cover moved from an end of the scope and pulled and released onto the top of the scope;

FIG. 12, a side elevation view as in FIG. 10, but with the rifle arranged to be carried muzzle down and the end cover of the partial scope cover removed from coverage of the distal end of the scope;

FIG. 13, a view like that of FIG. 12, but with the rifle arranged to be carried muzzle up and the end cover of the partial scope cover removed from coverage of the eye piece end of the scope;

FIG. 14, a bottom plan view of another embodiment of the invention;

FIG. 15, a similar view of still another embodiment of the invention;

FIG. 16, a vertical section view, taken on the line 16-16 of the scope cover embodiment of FIG. 15, partially broken away hemline to show an interior elastic member;

FIG. 17, a view like that of FIG. 10, but showing a pair of partial covers of the embodiment of FIG. 14 as a composite full cover; and FIG. 18, a view like that of FIG. 17, but showing a pair of partial covers of the embodiment of FIG. 15 and FIG. 16 as a composite full cover.

DETAILED DESCRIPTION

Referring Now to the Drawings

In the illustrated preferred embodiment of FIGS. 1-13, the partial scope cover, shown generally at 20 comprises a flexible, resilient and shock absorbing body 22, preferably made of reinforced polychloprene rubber such as that known by the trademark "Neoprene" or other suitable water repellant, stretch fabric.

Body 22 is preferably formed of a single cut piece of sheet material capable of being shaped and sewn or bonded to retain a rolled shape that will fit over a tube length gun scope.

Body 22 is shaped to have one end 24 formed by shaping end wings 26 and 28 to meet at the end 24, and to be sewn, bonded or otherwise secured together at seam 30, FIG. 6.

Wings 26 and 28 merge into side pieces 32 and 34, respectively. The side pieces 32 and 34 then respectively merge into a strap 38.

Strap 38 extends around an opening 40 that is provided centrally through body 22. Opening 40 is preferably an elongate slot that will facilitate use of the cover 20 with scopes of various sizes.

A circular disc 44 of plastic or other suitable substantially rigid material is covered with fabric 46, and the fabric is sewn at 48 to the end 24 of the rolled wings 26 and 28 to form a scope end lens cover, shown generally at 50.

The rifle scope partial cover 20 is used singly to partially cover a scope 60 having a mounting base 62 secured in conventional fashion to a weapon such as a rifle, shown generally at 64.

As shown best in FIGS. 8 and 9, a partial cover 20 is installed on the scope 60 by spreading opening 40 and pulling the body over the distal end 70 of the scope to place strap 38 in engagement with mounting base 62. Finger pull loop 66 is conveniently used to more easily stretch the body 22 until end cover 50 can be released and retracted to be positioned flush against the eye piece end 68 of the scope 60. The end cover 50 of partial cover 20 is easily removed from its position covering the eye piece end 68 of the scope 60 by simply pulling on finger pull loop 66 to stretch the resilient and elastic cover and by lifting the loop to raise the end cover 50 to be above the scope 60. Release of the loop 66 will allow the lens cover of the resilient cover 20 to rest on top of the eye piece end 68 of the scope 60.

To cover and protect the full length of the scope, a pair of scope partial covers 20 and 20' are used to form a composite full cover 74. Together the covers 20 and 20' effectively form the full length composite cover 74 to cover both the eye piece end 68 and the distal end 70 of the scope, while overlying and extending along opposite sides of the full length of the scope.

To install the full length composite full cover 74, the strap 38 of one partial cover, i.e., partial cover 20 is inserted through the opening 40' of the other partial cover 20'. Thereafter, opening 40 of partial cover 20 is slipped over one end, i.e., the distal end of scope 60, and partial cover 20 is pulled towards the eye piece end 68 of the scope until the strap 38 of partial cover 20 engages the mounting base 62. Continued pulling on the loop 66 and/or end cover 50 of a partial cover 20 will stretch the partial cover 20 and allow the lens end cover 50 to overlie one end of the scope, including the eye piece end 68 of scope 60.

Similarly, partial cover 20', which is at least substantially the same as the partial cover 20 is installed on the scope to overlie the other end of the scope 60. Partial cover 20' is installed on the scope in the same manner as partial cover 20 is installed. Partial cover 20' has the same components as does partial cover 20. Therefore, the individual components of partial cover 20' are identified herein by prime numbers that correspond to the numbers of the corresponding components of partial cover 20.

Partial cover 20' is installed on the scope by sliding opening 40' over the eye piece end 68 of scope 60 and pulling the lens end cover 50' towards the eye piece end of the scope until strap 38' engages the mounting base 62. Continued pulling on the end lens cover 50', as by pulling on the pull loop 66', positions the lens cover 50' to drop over and to be released against the distal end 72 of the scope 60. The lens cover 50' is removed from the distal end 72 of the scope by pulling on and lifting the loop 66' to raise the end cover 50' to the top of the scope. Releasing loop 66' allows the end cover 50' to rest on the top of the distal end of the scope.

Composite scope cover 74 is removed from either end of scope 60 by pulling and lifting either the appropriate loop 66 or loop 66' at the lens end of the scope to be uncovered. Either end cover 50 or 50' can be pulled and lifted from an end of the scope or both end covers 50 and 50' can be pulled and lifted. Because of the elastic nature of the material from which the partial covers are made the end covers, when released, will retract to rest on top of the ends of the scope until they are moved back into position covering the eye piece and distal ends of the scope, or until the partial covers are removed from the scope.

If, for example rifle 64, having an installed composite pull cover 74, is carried "muzzle down" (FIG. 12), lens cover 50 of partial cover 20 can be in position covering the eye piece end 68 of the scope and lens cover 50' of partial cover 20' can be resting on the top of the distal end of the scope 60. The user need only remove lens cover 50' of partial cover 20' from the distal end 70 of the scope to have the scope ready for use during aiming and shooting.

Similarly, if the rifle is carried "muzzle up" (FIG. 13), the lens at the distal end 68 can be protected while the eye piece end can be uncovered.

In the embodiment of the invention shown in FIG. 14, a partial scope cover is shown generally at 80. Partial cover 80 has a body 82 including a generally cylindrical forward section 84 having a length that is about one-half the distance from a central portion of a scope base mount to just short of one end of the scope. A slot 88 formed in a bottom surface 90 of the body 82 extends from the base mount end 92 of the body 82 to an enlarged opening 94 located at the lens cover end 96 of the partial cover 80.

Strap 100 is non-elastic but ends 102 and 104 are respectively connected to opposite sides of the body 82 by elastic resilient connectors 106 and 108.

When used to partially cover a gun scope, the strap 100 is passed over the end of the scope opposite the end of the scope to be covered by lens cover 96 portion of the partial cover 80. The strap 100 is then pulled into engagement with the base mount of the scope as the lens cover is pulled to the end of the scope to be covered. Continued pulling of the end lens cover 96 stretches the elastic resilient connectors 106 and 108 to allow the end lens cover to be placed over an end of the scope. Release of the end cover allows the elastic resilient connectors 106 and 108 to relax and to pull the end cover 96 against the end of the scope, thereby covering an eye piece or distal end lens of the scope.

A pair of substantial similar partial scope covers 80 and 80' are used to make a composite full scope cover 110 (FIG. 17). The full cover 110 is formed by inserting the strap 100 of a first partial cover 80 through the space between the strap 100 and body 82 of a second partial scope cover. The strap 100 of the first partial cover is passed over one end of a scope and is pulled into engagement with the base mount. The strap 100' of the second partial cover 80' is passed over the other end of the scope and into engagement with an opposite end of the base mount. Thereafter, the lens cover 96 of the first partial cover 80 is released to cover one lens of the scope. The lens cover 96' of the second partial cover 80' is then similarly pulled and released to cover the other lens of the scope.

In the embodiment of the invention shown in FIGS. 15 and 16, a partial scope cover 120 includes a flexible body 122 made of suitable material such as fabric or plastic. Body 122 is elongate and extends from a front end 124 to a rear end 126. A top surface 128 extends between the front end 124 and a rear end 126. A wall 130 extends downwardly and inwardly from top surface 128, the front end 124 and the rear end 126. An elastic strip 132 is sewn or otherwise affixed to the bottom edge of the wall 130.

An opening 134 is formed through the top surface 128, and closely spaced from the rear end 126. Opening 134 is large enough to fit over either the eye piece end or the distal end of a gun scope.

A lens cover 136 is formed at the front end portion of the body 122. The portion of body 122 extending alongside opening 134 and from a front end 138 of the opening towards the rear end 126 and between the opening 134 and the rear end 126 form a strap 140.

In use, the partial cover 120 is installed on and is used to cover and protect about one-half of a gun scope. The partial cover is installed by sliding opening 134 over one end of the scope until strap 140 engages a base mount on which the scope is mounted. Continued pulling on the front end 124 will stretch the resilient elastic strap 132 and the body 122 until the lens cover 136 will fit over and cover an end of the scope. The top surface 128 and wall 130, respectively, cover the top and sides of the scope. When the lens cover 136 is pulled beyond the lens end of the scope and is released, the lens cover is pulled by the relaxing elastic strap to rest on the top of the lens end of the scope.

A composite full scope cover 150 is formed by a pair of partial scope cover 120 and 120'. The composite full cover 150 is formed by inserting strap 140 of a first partial scope cover 120 through an opening 134' of a second partial cover 120'. The strap 140 of the first partial cover is passed around one end of a scope and the first partial cover 120 is positioned as previously described against the scope mount. The strap 140' of the second partial cover 120' is passed around the opposite end of the scope and is positioned as previously described against the scope mount.

In each herein disclosed embodiment of the composite gun scope cover of the invention a pair of partial scope covers are provided. Each partial scope cover includes a body having an upper surface length and spaced apart side walls to cover about one-half of the length of a gun scope. Each partial cover includes an end lens cover to fit over either the eye piece end or the distal end of a gun scope at one end of the partial cover body. The other end of the partial cover body has a strap thereon and an opening is provided between the strap and the body through which a strap of a second partial cover is inserted when a pair of partial covers are interconnected to form a composite full scope cover. A resilient connection is formed between the remote end of the strap and the end lens cover at the opposite end of the partial cover. The resilient connection allows the end cover to be stretched over an end of a scope and to be moved to rest on the scope. The resilient connection may be integral with the partial cover body, or it may be positioned between the body and the strap. Further the resilient means may extend from the lens cover to the end of the strap engaging a scope mount.

Although a preferred embodiment of my invention has been herein described, it is to be understood that the present disclosure is by way of example and that variations are possible without departing from the subject matter coming within the scope of the following claims, which subject matter I regard as my invention.

I claim:

1. A partial gun scope cover, comprising:

an elongate body to cover top and side portions of a scope extending from a lens of the scope to a central portion of the scope;

a lens cover at an end of the elongate body to cover the lens of the scope; and a strap at an opposite end of the elongate body to engage a scope mount coupling the scope to a gun, wherein the elongate body is at least partially formed of a resilient, stretchable material to secure the gun scope cover to the scope when the lens cover is disposed to cover the lens and the strap is disposed to engage the scope mount, wherein at least a portion of the strap is formed as a continuation of the resilient, stretchable material from which the elongate body is made and the elongate body and the strap are configured to form an opening to engage the scope mount.

2. The partial gun scope cover of claim 1, wherein the elongate body is configured to cover a majority of the scope.

3. The partial gun scope cover of claim 1, wherein the elongate body is configured to cover top and side portions of about one-half of a length of the scope.

4. The partial gun scope cover of claim 1, wherein the strap is at least partially formed of a resilient, stretchable material.

5. The partial gun scope cover of claim 1, wherein a portion of the elongate body that covers top and side portions of the scope is at least partially formed of a resilient, stretchable material.

6. The partial gun scope cover of claim 1, wherein the end lens cover is shaped to fit flat against an end of the scope and is fixed to the elongate body.

7. The partial gun scope cover of claim 1, wherein the elongate body is made of polychloroprene material.

8. The partial gun scope cover of claim 1, wherein the elongate body and the strap are formed from a single piece of material and the opening is a stretchable opening.

9. The partial gun scope cover of claim 1, wherein the elongate body is formed from a rolled sheet of material at the lens cover end.

10. The partial gun scope cover of claim 1, wherein the lens cover is formed as an integral part of the elongate body.

11. The partial gun scope cover of claim 1, wherein the elongate body is tapered from the lens end to the strap end.

12. The partial gun scope cover of claim 1, wherein the lens cover is configured to be rigid over an eyepiece of the scope.

13. The partial gun scope cover of claim 1, further comprising a pull tab proximate to the lens cover configured to allow a user to grasp the partial gun scope cover when stretching the elongate body.

14. A method of using a partial gun scope cover, comprising:

disposing a strap of a partial gun scope cover about an end of a scope to engage a scope mount that couples the scope to a gun, wherein the strap is at an end of an elongate body of the partial gun scope cover and a lens cover is at an opposite end of the elongate body, the elongate body being at least partially formed of a resilient, stretchable material;

extending the elongate body over a central portion of the scope to a lens of the scope; and disposing the lens cover over the lens of the scope, wherein the elongate body covers top and side portions of the scope and the resilient, stretchable material of the elongate body secures the gun scope cover to the scope; and removing the lens cover from the lens of the scope and positioning the lens cover to allow use of the scope.

15. The method of claim 14, further comprising:

disposing a strap of a second partial gun scope cover about an end of a scope to engage a scope mount opposite the scope mount engaged by the first partial gun scope cover;

extending an elongate body of the second partial gun cover over the central portion of the scope to a lens of the scope opposite the first partial gun scope cover; and disposing a lens cover of the second partial gun scope cover over the lens of the scope opposite the first partial gun scope cover, wherein the second partial gun scope cover elongate body covers top and side portions of the scope at an end opposite the first partial gun scope cover and a resilient, stretchable material of the second partial gun scope cover elongate body secures the second partial gun scope cover to the scope.

16. The method of claim 15, further comprising removing the lens cover of the second partial gun scope cover from the lens of the scope opposite the first partial gun scope cover and positioning the lens cover of the second partial gun scope cover to allow use of the scope.

* * * * *